United States Patent [19]

Chen

[11] 4,062,578

[45] Dec. 13, 1977

[54] DOOR SAFETY LATCH

[75] Inventor: Trevor G. Chen, Miami, Fla.

[73] Assignee: Trepege Products Inc., Coral Gables, Fla.

[21] Appl. No.: 754,554

[22] Filed: Dec. 27, 1976

[51] Int. Cl.[2] ..... E05C 17/16

[52] U.S. Cl. ..... 292/262; 16/144; 292/269

[58] Field of Search ..... 292/262, 268, 269, 270; 16/141, 144

[56] References Cited

U.S. PATENT DOCUMENTS

| | | | |
|---|---|---|---|
| 372,326 | 11/1887 | Palmenberg | 292/268 |
| 534,716 | 2/1895 | Hillgendorf | 292/268 |
| 1,497,500 | 6/1924 | Gorowitz | 292/268 X |
| 2,097,349 | 10/1937 | Sladek | 292/338 |

*Primary Examiner*—Richard E. Moore
*Attorney, Agent, or Firm*—Salvatore G. Militana

[57] ABSTRACT

A door safety latch permitting the partial opening of a door consisting of an arcuate lug mounted on the door, and having an enlarged ball portion mounted on the end thereof, with a fastening member mounted in the door frame having a pivoted yoke portion whose spaced apart leg portions prevent the ball portion of the lug from passing therethrough. At the pivoted end of the yoke portion, the leg portions are sufficiently spaced apart to permit the ball portion to pass therethrough. When the door is in a closed position and the safety latch swung to the position to permit only a partial opening of the door, the arcuate lug will extend through the space between the leg portions. In order to prevent the pivoting of the yoke by a person on the outside of the door, as by a burglar, means are provided offering frictional resistance to the turning movement of the yoke so that he is unable to cause the yoke to swing from its door locking position to the position that permits the door to open to its completely open position.

1 Claim, 6 Drawing Figures

DOOR SAFETY LATCH

BACKGROUND OF THE INVENTION

1. Field of The Invention

This invention relates to door locking devices and is more particularly directed to a safety latch that permits only a partial opening of a door.

2. Description Of The Prior Art

There are presently two types of door safety latches that permit the partial opening of a door so that a person within the dwelling can see who is at the door. Both types operate on the same principle except that one type uses a slide member on the end of a chain while the other uses a pivoted yoke. It has been discovered that these door safety latches can be manipulated by a person such as a burglar from the outside of the door so that a latch that was positioned to permit only the partial opening of a door can be manipulated to permit the total opening of the door. This is accomplished by the use of a rubber band which is secured at one end by a thumb tack in an appropriate position on the wall adjacent to the door and the other end under tension to the slide member or to the free end of the yoke with the door only partially opened. Now when the door is closed, the tension of the rubber band will cause the slide member or the yoke to move to the position which causes the safety latch to permit the door to open to its completely open position. This thereby renders the safety latch unable to perform the purpose intended, namely, to permit the door to be opened only partially for the purpose of recognizing the person wishing to pass through the door. The present invention contemplates preventing a person from being able to manipulate a door safety latch from the outside of the door.

Summary Of The Invention

Therefore a principle object of the present invention is to provide a safety door latch that permits only the partial opening of a door from being manipulated by a person outside the door.

A further object of the present invention is to provide a safety door latch with a lug that is mounted on a door and a pivoted yoke mounted on a door frame that engages the lug to permit the door to be only partially opened and which yoke cannot be manipulated from the outside when the latter is positioned for permitting the partial opening of the door.

A still further object of the present invention is to provide a safety door latch for the partial opening of a door with a pivoted yoke that engages a detent thereby preventing the manipulation of the yoke from the outside of the door.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
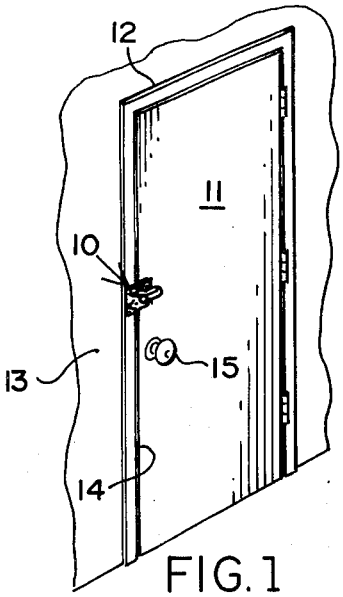
FIG. 1 is a perspective view of a wall including a door upon which my door safety latch is mounted.

Referring to the drawing wherein like numerals are used to designate similar parts throughout the several views, the numeral 10 refers to a door safety latch constructed in accordance with my invention and shown mounted in position on a door 11 hinged to a door frame 12 on a wall 13 at an opening 14. Like all door safety latches that permit a partial opening of the door, the device 10 is mounted on the door 11 and door frame 12 in proximity of the door knob 15. The door safety latch 10 consists of a keeper —K— mounted on the door 11 and a fastener —F— mounted on the door frame 12.

The keeper —K— which consists of a flat base member 20 is secured to the door 11 by screws 21. A lug 22 extends angularly and outwardly of the base member 20 in the direction of the fastener —F— terminating in a spherical member or ball 23 having a diameter greater than the width of the lug 21.

Figure 4:
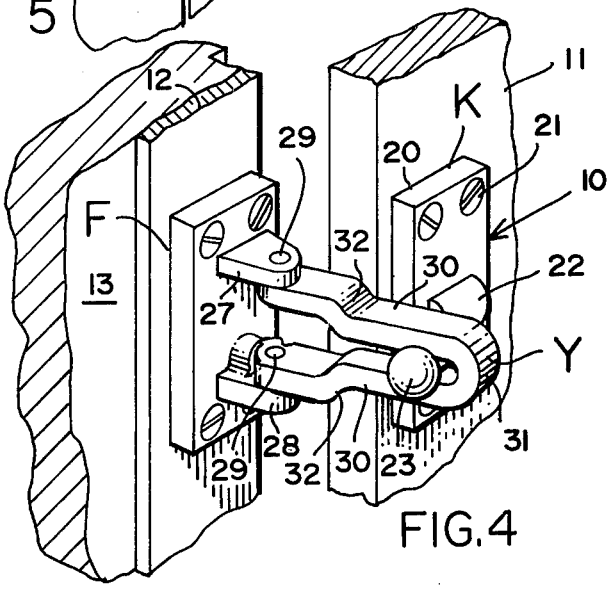
FIG. 4 is a similar view showing the door in its partial opened positioned.

The fastener —F— which is mounted on the door frame 12 adjacent to the keeper —K— is provided with a flat base member 25 that is fastened by screws 26 to the door frame 12. Mounted on the base member 25 is a pair of lugs 27 and 28 extending outwardly thereof in spaced relation to each other. The free ends of the lugs 27 and 28 are each provided with a pivot pin 29 for pivotally mounting a yoke —*y*— thereon. The yoke —*y*— consists of a pair of leg portions 30 joined at their free end as a 31 and extend in parallel relation for a portion of the distance toward the lugs 27 and 28 at which position 32 the leg portion 30 extend in a direction away from each other to increase the space between the legs 30 for the remainder of the distance to the lugs 27, 28 where the pivot pins 29 pivotally secure the yoke —*y*— to the lugs 27 and 28. The space between the leg portions 30 of the yoke —*y*— that extend to the free end 31 from the bent portions 32 is equal to width of the lug 22 of the keeper —K— and permits the lug 22 to slide along the yoke —*y*—. The ball 23 prevents the keeper —K— from becoming separated from the fastener —F— as the lug 22 is in that portion of the yoke —*y*— and the door 11 can be only partially opened as shown by FIG. 4. However, the ball 23 is free to slide out from between the leg portions 30 when the ball 23 is positioned in that portion of the yoke —*y*— that extends from the bent portions 32 to the pivot pins 29. At this position, the ball 23 of the keeper —K— becomes separated from the fastener —F— and the door 11 can then be swung to its completely open position.

The fastener —F— is provided with means to maintain the yoke —*y*— in a locking position or in one of two opening positions consisting a detent —D— mounted in a cavity 33 formed in the lug 28. The detent —D—, which is made of resilient plastic material, consists of a base portion 34, a body portion 35 extending outwardly thereof. A head portion 36 is attached as at 37 to the body portion 35, the joining member 37 is of smaller diameter than that of the body member 35 or the head member 36 to permit movement of the head member 36 as is explained hereinafter. The head member 36 bears against inner arcuate end portion 38 of one of the legs 30 of the yoke —*y*— which portion 38 is provided with three stepped surfaces 40, 41 and 42 disposed about arcuate end portion 38. The head portion 36 engages each of the stepped portions as the yoke —*y*— is swung from one extreme position, the non-locking position to the other extreme position, namely the locking position.

Figure 3:
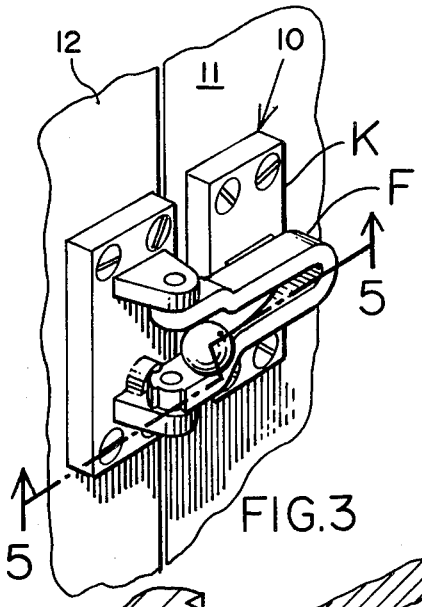
FIG. 3 is a similar view with latch in position to permit only a partial opening of the door.
Figure 6:
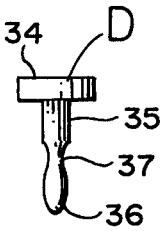
FIG. 6 is a side elevational view of my plastic detent.
Figure 5:
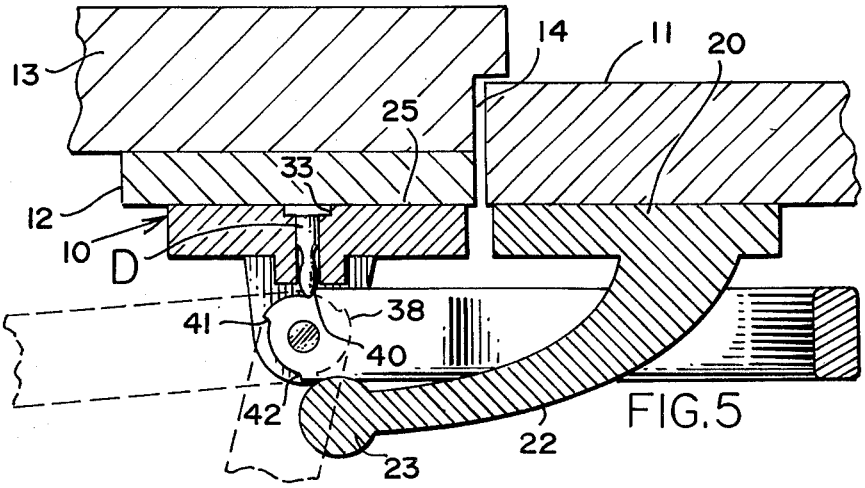
FIG. 5 is a cross sectional view taken along the line 5—5 of FIG. 3.

In the normal use of my door safety latch 10, when it is desired to permit only the partial opening of the door 11, the yoke —*y*— is swung in the direction of the door 11. In this position the head 36 of the detent —D— will engage the stepped surface 40 and the lug 22 will extend between the leg portions 30 of the yoke —*y*— as shown in FIG. 3 and the solid lines of FIG. 5. Now, when the door 11 is swung to its open position, lug 22 along with the ball 23 will slide along and between the leg portions 30. Since the ball 23 is larger than the space between the leg portion 30, the lug 22 will slide toward the end 31 of the yoke —*y*— until the ball 23 engages the end portion 31 of the yoke —*y*— to prevent any further opening of the door 11 as shown by FIG. 4.

If it is desired that the door 11 be permitted to swing to its completely open position, the yoke —*y*— is then swung about its pivot pins 29 to cause the head 36 of the detent —D— to engage either the stepped surface 41 or 42. In this position, the ball 23 of the keeper —K— will be found between the leg portions 30 that extend from the bent portion 32 to the pivoted end portions. At this position, wherein the space between the legs 30 is greater than the diameter of the ball 23, the latter along with the keeper —K— is free to move away from the fastener —F— as the door 11 may be swung to its completely open position.

Figure 2:
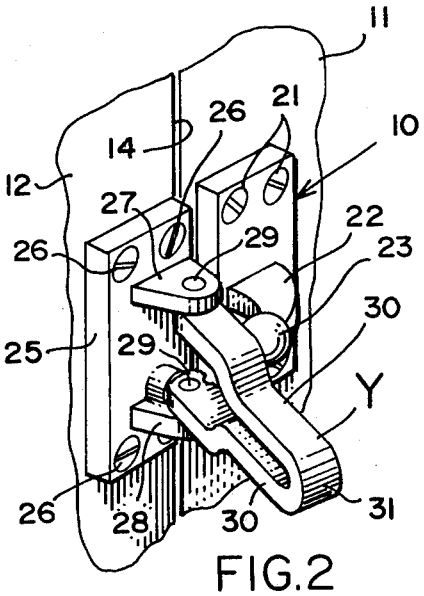
FIG. 2 is a similar but enlarged view of my door safety latch with the latter in position to permit the opening of the door to its completely opened position.

The function of the detent —D— and the stepped surfaces 40, 41 and 42 on the yoke —*y*— is to offer frictional resistance to the swinging movement of yoke —*y*— so that a person outside the door cannot swing the yoke to the position that permits the opening of the door. For example, if the yoke —*y*— swung easily, when the door is partially opened as shown by FIG. 4, a person can easily insert his hand through the opening. By use of a rubber band, which he fastens to the end portion 31 of the yoke —*y*— and stretches the rubber band to fasten the other end to the wall 13 by a thumb tack so that when the door 11 is now closed, the tension of the rubber band will swing the yoke about the pivot pins 29 in the direction of the wall 13 to the position shown by FIG. 2. The door 11 can now be opened to its completely open position.

What I claim as new and desire to secure by Letters Patent is:

1. A door safety latch comprising substantially arcuate lug means adapted to be mounted on a door, a substantially enlarged head mounted on the free end of said lug means, a base member adapted to be mounted on a wall adjacent said lug means, yoke means having spaced apart leg portions, means pivotally mounting free ends of said leg portions to said base member, a plurality of stepped surfaces mounted on said free end of one of said leg portions, said leg portions being sufficiently spaced apart adjacent to said pivot means to permit said enlarged head to pass therethrough and the rest of said leg portions being only sufficiently spaced apart to permit said lug means to slide therethrough and detent means mounted at said pivot means providing substantial resistance to the pivotal movement of said yoke means, said detent means having a bore in said base member in substantial alignment with said stepped surfaces, a substantially elongated detent member secured in said bore having a free end portion engaging said stepped surface, said detent member having a substantially pointed free end portion and being reduced in diameter in proximity of its mid-portion permitting said detent member to bend at said mid-portion to become foreshortened as said stepped surfaces move past said detent member upon applying increased forces at said yoke means, said detent member engaging one of said stepped surfaces upon the partial opening of said door.

* * * * *